US007360962B2

(12) United States Patent
To

(10) Patent No.: US 7,360,962 B2
(45) Date of Patent: Apr. 22, 2008

(54) RING BINDER MECHANISM

(75) Inventor: Chun Yuen To, Kauto Shan Shatin (HK)

(73) Assignee: World Wide Stationery Manufacturing Company Limited, Hong Kong (CN)

( * ) Notice: Subject to any disclaimer, the term of this patent is extended or adjusted under 35 U.S.C. 154(b) by 414 days.

(21) Appl. No.: 10/613,479

(22) Filed: Jul. 3, 2003

(65) Prior Publication Data

US 2004/0013463 A1 Jan. 22, 2004

(30) Foreign Application Priority Data

Jul. 19, 2002 (CN) ..... 02 1 26364

(51) Int. Cl.
*B42F 3/04* (2006.01)
*B42F 13/26* (2006.01)

(52) U.S. Cl. ..... 402/39; D19/27

(58) Field of Classification Search ..... 402/26, 402/31, 39, 5, 34, 36–38, 41, 70, 73; D19/26, D19/27

See application file for complete search history.

(56) References Cited

U.S. PATENT DOCUMENTS

| | | | | |
|---|---|---|---|---|
| 724,849 | A | 4/1903 | Gresham | |
| 778,992 | A * | 1/1905 | Nelson | 402/56 |
| 842,851 | A | 2/1907 | Boden | |
| 1,816,021 | A * | 7/1931 | Meyerson | 402/36 |
| 2,460,718 | A * | 2/1949 | Stevens | 402/26 |
| 3,104,667 | A | 9/1963 | Mintz | |
| 3,331,373 | A * | 7/1967 | Lohmeier | 402/8 |
| 3,728,036 | A * | 4/1973 | Cott | 402/31 |
| 4,678,357 | A * | 7/1987 | Kissel et al. | 402/39 |
| 4,690,580 | A | 9/1987 | Kissel | |
| 5,018,896 | A * | 5/1991 | Vanni | 402/38 |
| 5,765,956 | A * | 6/1998 | Lanzarin | 402/26 |
| 6,217,247 | B1 * | 4/2001 | Ng | 402/36 |
| 6,270,280 | B1 * | 8/2001 | Baumann | 402/39 |
| 6,328,497 | B1 * | 12/2001 | To | 402/26 |
| 6,761,497 | B2 * | 7/2004 | Kaneda | 402/31 |
| 7,275,886 | B2 * | 10/2007 | Cheng | 402/73 |
| 2003/0044221 | A1 * | 3/2003 | To et al. | 402/41 |
| 2005/0207826 | A1 * | 9/2005 | Cheng et al. | 402/31 |
| 2005/0260029 | A1 * | 11/2005 | Wong | 402/26 |

OTHER PUBLICATIONS

Wikipedia entry for "Cylinder (geometry)", printed Jan. 24, 2007, Wikimedia Foundation, Inc., pp. 1-2.*

* cited by examiner

*Primary Examiner*—Monica Carter
*Assistant Examiner*—Eric A. Gates
(74) *Attorney, Agent, or Firm*—Milde & Hoffberg, LLP

(57) ABSTRACT

The present invention relates to a ring binder mechanism for binding the sheets of loose leaves. The mechanism comprises an elongated spring plate that extends longitudinally and, in profile, has a shallow U-shaped configuration and opposite edges which extend substantially toward each other; two parallel elongate hinge plates supported by said spring plate for pivotal toggle motion relative to the spring plate about a central hinge line, which are mounted in parallel and retained by the opposite edges of the spring plate; and a plurality of rings for clasping said sheets of loose leaves. Each of the rings comprises a pair of half ring elements of circular cross-section which are mounted on said hinge plates, with one half ring element of each pair being attached to one of the hinge plates and the other half ring element of the pair attached to the other hinge plate, with the two half ring elements of each pair in substantial alignment.

7 Claims, 21 Drawing Sheets

RING BINDER MECHANISM

FIELD OF THE INVENTION

The present invention relates to a ring binder mechanism for binding the sheets of loose leaves, especially to a binder mechanism with improved ring elements which can close tightly.

BACKGROUND OF THE INVENTION

A ring binder is applied to secure loose leaves, such as punched paper, into a file folder or a notebook. It is characterized by ring elements for securing paper, wherein the ring elements can be opened optionally to add or remove paper, or closed to secure paper, while allowing paper to move along them. Generally a lever is provided on both ends of the binder to move the ring elements between an opened position and a closed position.

FIGS. 20 and 21 show a ring binder according to the prior art. In the conventional ring binder, end faces 56 of half ring elements 54 form an engagement configuration with a convex portion and a concave portion. When the end faces 56 of the two half ring elements 54 close, the convex portion of the end face 56 of one half ring element engages with the concave portion of the end face 56 of the other half ring element. One disadvantage of this type of engagement configuration is that the end faces can not close tightly and align to each other exactly when two half ring elements close, so that vertical and transverse misalignments for the engagement configuration will occur, as illustrated in FIGS. 20 and 21. Owing to the disadvantage that the end faces 56 of the binder which engage with each other misalign up and down, paper which is bound by the binder can not be turned over smoothly, and can even be torn.

SUMMARY OF THE INVENTION

An object of the present invention is to provide a ring binder mechanism that can overcome the above mentioned disadvantages of the prior art so as to enable the ring members to close tightly and align to each other exactly and eliminate the vertical and transverse misalignment.

This object is achieved according to the present invention by providing a ring binder mechanism for binding the sheets of loose leaves, the mechanism comprising: an elongated spring plate that extends longitudinally and, in profile, has a shallow U-shaped configuration and opposite edges which extend substantially toward each other;

two parallel elongate hinge plates supported by said spring plate for pivotal toggle motion relative to the spring plate about a central hinge line, the hinge plates being mounted in parallel and retained by the opposite edges of the spring plate;

a plurality of rings for clasping said sheets of loose leaves, each of the rings comprising a pair of half ring elements mounted on said hinge plates, with one half ring element of each pair being attached to one of the hinge plates and the other half ring element of the pair attached to the other hinge plate, with the two half ring elements of each pair in substantial alignment, the pairs of half ring elements being movable with said hinge plates to toggle between an open position and a closed position and forming a substantially annular shape when in the closed position;

wherein free ends of the half ring of each pair elements form a nesting configuration when in the closed position, the free end of one half ring element of each pair having a centrally concave nesting portion and the free end of the other half ring element of the pair having a centrally convex nesting portion, said concave portion and said convex portion being symmetrical about an axis line of the respective ring elements of the pair, so that when the pair of half ring elements are in the closed condition, the free ends of the half ring elements are aligned to each other, and form a surface-engagement, so that the convex resting portion and the concave nesting portion are nested together tightly.

Preferably, the nesting portion with a centrally convex portion is formed in a free end of one half ring element of said pair of half ring elements, and the nesting portion with a centrally concave portion is formed in a free end of the other engaging half ring element, the convex nesting portion has an annular conical surface, the concave nesting portion has a conical hole that is formed from its external end surface, a diameter of the conical hole on the external end surface is smaller than that of the cylindrical rod of the half ring element, a cone angle of the conical hole is smaller than that of the annular conical surface of the centrally protruding outwards nesting portion, when the half ring elements are in the closed condition, and the connecting portion between the external end surface of the concave nesting portion and the conical hole thereof engages with the annular conical surface of the convex nesting portion, so that the centrally convex nesting portion is nested in the centrally concave nesting portion.

Preferably, the nesting portion with a centrally convex portion is formed in a free end of one half ring element of said pair of half ring elements, and the nesting portion with a centrally concave portion is formed in a free end of the other engaging half ring element, the convex nesting portion has a protruding portion, the protruding portion is connected to a surface of the cylindrical rod of the half ring element via an annulus internal end surface, a diameter of the protruding portion on the internal end surface is smaller than that of the cylindrical rod of the half ring element, the concave nesting portion has a opening that is formed from its external end surface, a diameter of the opening on the external end surface is smaller than that of the cylindrical rod of the half ring element and slightly larger than that of the protruding portion on its internal end surface, when the half ring elements are in the closed condition, and the external end surface of the concave nesting portion and the internal end surface of convex nesting portion form a surface-engagement, so that the convex nesting portion is nested in the concave nesting portion.

Preferably, the protruding portion of the convex nesting portion has a conical shape, the opening of the concave nesting portion has a conical hole that is formed from its external end surface and an internal cylindrical hole that is connected to the conical hole.

Preferably, the protruding portion of the convex nesting portion has a shape that consists of a cylindrical tip and an arc-shaped annular conical base portion, and the opening of the concave nesting portion has a conical hole that is formed from its external end surface and an internal cylindrical hole that is connected to said conical hole.

Preferably, the protruding portion of the convex nesting portion has a cylindrical shape, the opening of the concave nesting portion has a shape of an internal cylindrical hole.

Preferably, the nesting portion with a centrally convex portion is formed in a free end of one half ring element of the pair of half ring element pairs, and the nesting portion with a centrally concave portion is formed in a free end of the other engaging half ring element, the convex nesting portion has a protruding conical portion, the conical portion is connected to a surface of the cylindrical rod of the half ring element via an annulus internal end surface, a diameter of the conical portion on the internal end surface is smaller than that of the cylindrical rod of the half ring element, the concave nesting portion has a conical hole that is formed from its external end surface, a diameter of the conical hole on the external end surface is smaller than that of the cylindrical rod of the half ring element and substantially equal to that of the protruding conical portion on the internal end surface, when the half ring elements are in the closed condition, the external end surface of the concave nesting portion and the internal end surface of the convex nesting portion form a surface-engagement, and the conical portion of the convex nesting portion and the conical hole of the concave nesting portion form an engagement, so that the concave nesting portion is nested in the convex nesting portion.

Preferably, the pair of half ring elements of the ring binder mechanism form a circular ring.

Preferably, one half ring element of said pair of half ring elements of the ring binder mechanism has a straight side.

Preferably, two, three, four or more rings are provided in the ring binder mechanism.

Preferably, the rings are made of metal material, and the metal material can be steel.

Preferably, the rings are made of plastic material.

DETAILED DESCRIPTION OF THE PREFERRED EMBODIMENTS

In all the above-mentioned figures, the corresponding parts are indicated by corresponding reference numbers.

Figure 1:
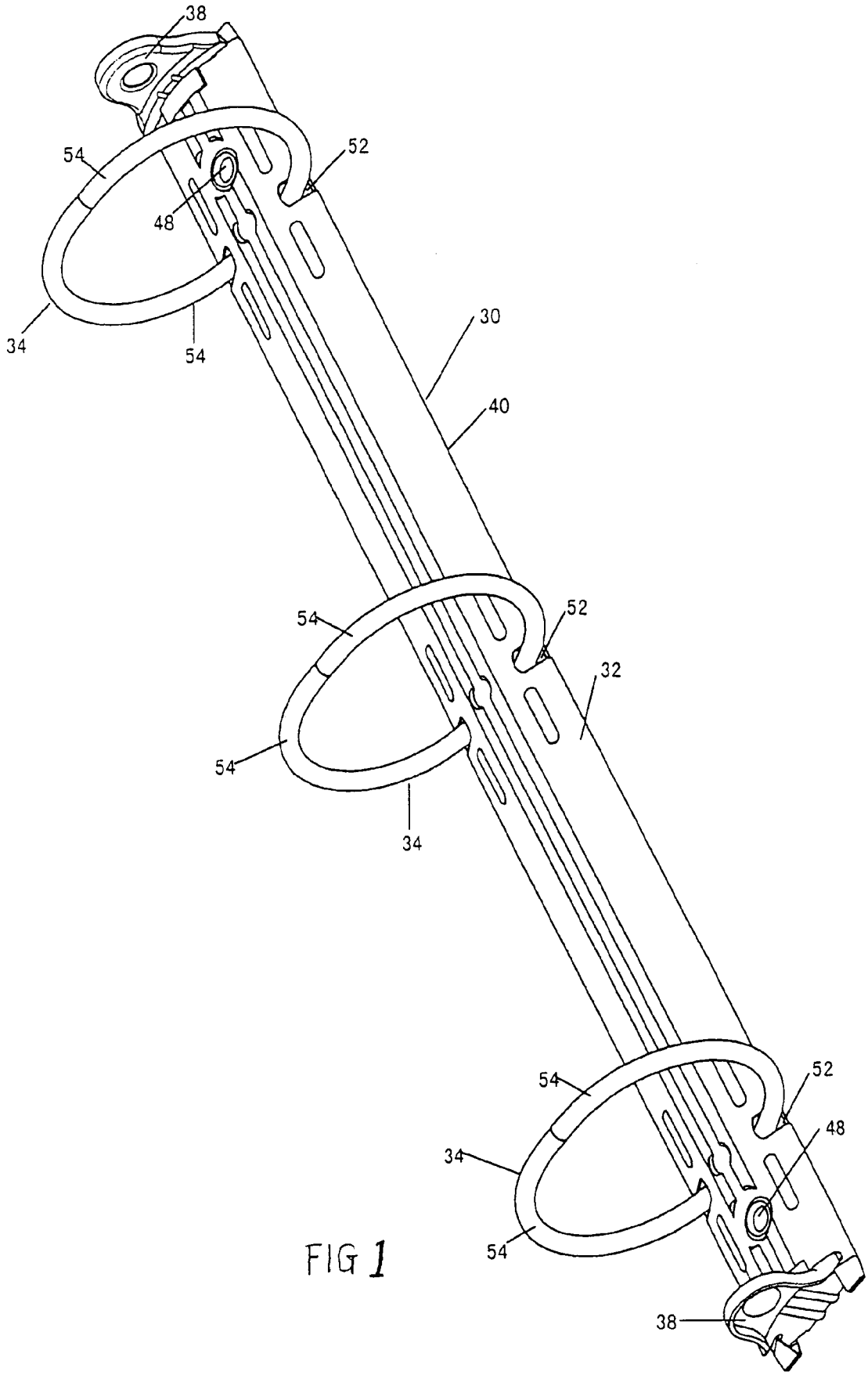
FIG. 1 is a top perspective view showing a ring binder mechanism in a closed condition according to one embodiment of the present invention.
Figure 2:
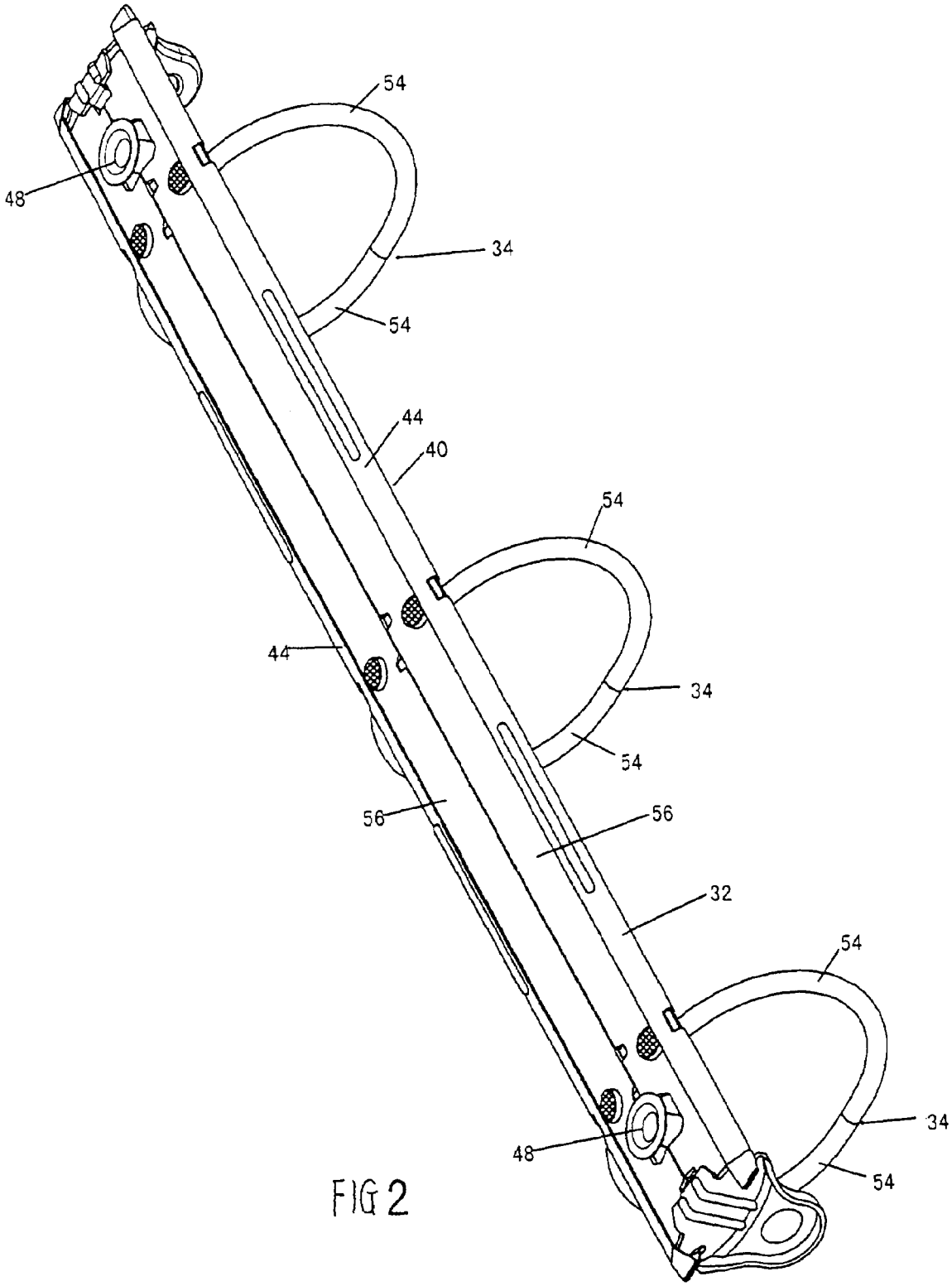
FIG. 2 is a bottom perspective view showing the ring binder mechanism in FIG. 1.
Figure 5:
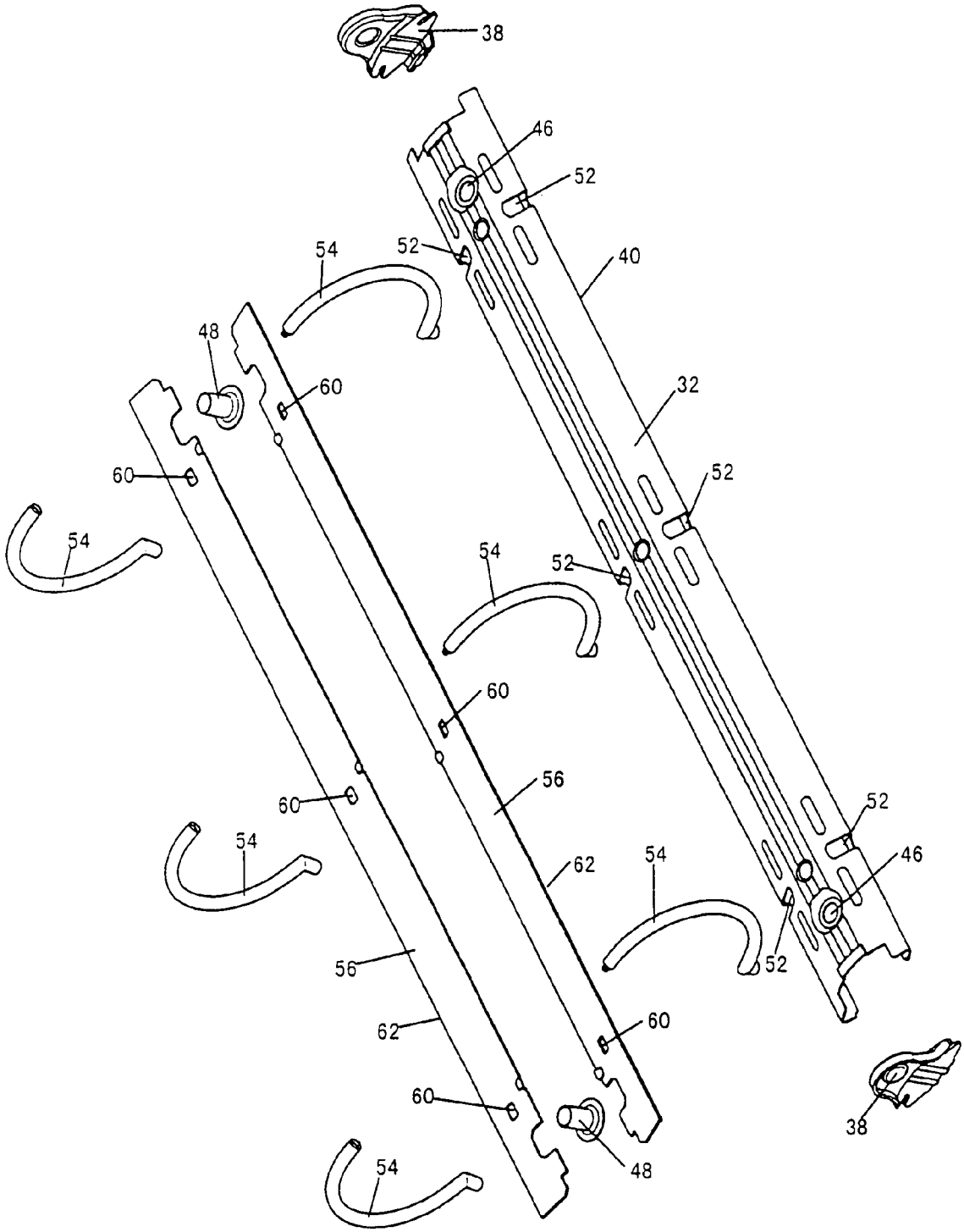
FIG. 5 is a top exploded perspective view showing the ring binder mechanism in FIG. 1.

Now referring to the above-mentioned figures, especially to the FIGS. 1, 2 and 5, the ring binder mechanism according to the present invention for binding the sheets of loose leaves is generally indicated by 30. This mechanism includes an elongated plate 32 and three rings. The three rings are generally indicated by 34 and used to secure the sheets of loose leaves.

The plate 32 has a shape, viewed from the top or bottom, of an elongated rectangle and has a substantially arc-shaped (U-shaped) cross section with a rising portion thereof along its longitudinal direction. The plate 32, as shown, has two ribs that extend along the longitudinal direction in the middle thereof. The plate 32 has two substantially opposite longitudinal edges 40 and substantially opposite transverse ends. A bent bottom edge 44 is formed each along both of the longitudinal edges 40 (FIG. 2). The opposite longitudinal edges are therefore directed toward each other. The plate 32 can be configured in profile as an upside down "U" as shown. The elongated plate 32 is made of metal or any other suitable material which has enough rigidity and can provide a stable attachment for other parts of the mechanism, while light-weight, material-saving and cost-saving. Two holes 46 are provided in the plate 32 (FIG. 5) for receiving and attaching a bushing 48 respectively, so that the mechanism can be fastened in a file folder of a notebook. Six additional holes 52 are positioned along the longitudinal edges 40 for receiving a ring that passes therethrough respectively. Those plates or shells that have other kinds of shapes, including irregular shapes, or those mechanisms that are formed in a file folder or a notebook integrally, all fall within the scope of the present invention.

Figure 3:
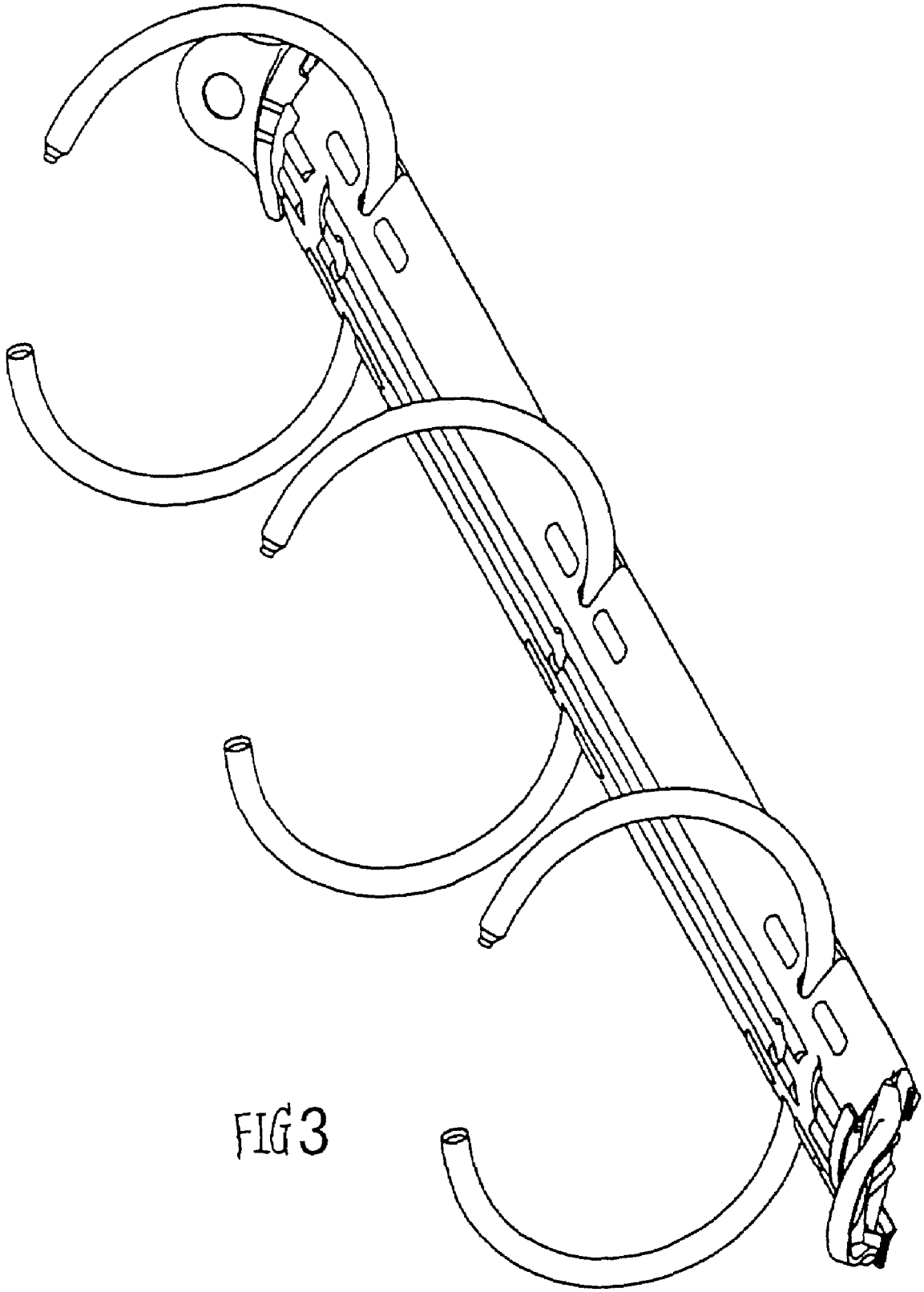
FIG. 3 is a top perspective view showing the ring binder mechanism in FIG. 1 in the opened condition.

Each of the three rings 34 comprises two half ring elements 54 that can move between a closed position (FIGS. 1 and 2) and an opened position (FIGS. 3 and 4), in which in the closed position each of the ring element forms a continuously closed ring for securing sheets of loose leaves, and in the opened position each of the ring element forms a discontinuously opened ring for adding or removing sheets of loose leaves. The ring element 54 is formed by a substantially cylindrical rod that is made of a suitable material, such as steel. Although in the embodiment shown the two half ring elements 54 of each of the three rings 34 are both movable, a mechanism that has one movable half ring element and one fixed half ring element also falls into the scope of the present invention. Furthermore, those kinds of mechanism which have various numbers, such as more than or less than three rings all fall into the scope of the present invention.

Figure 4:
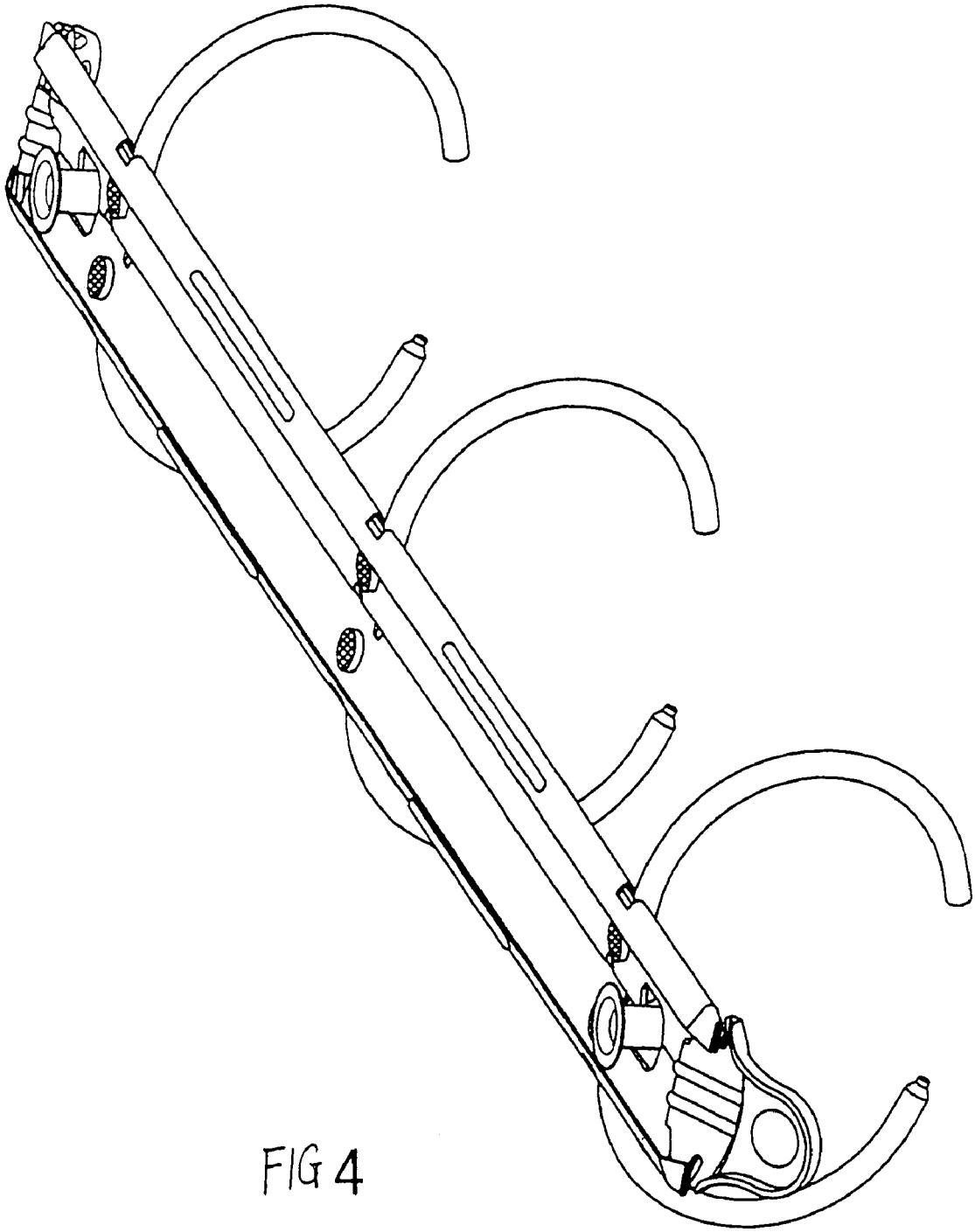
FIG. 4 is a bottom perspective view showing the ring binder mechanism shown in FIG. 3.
Figure 6:
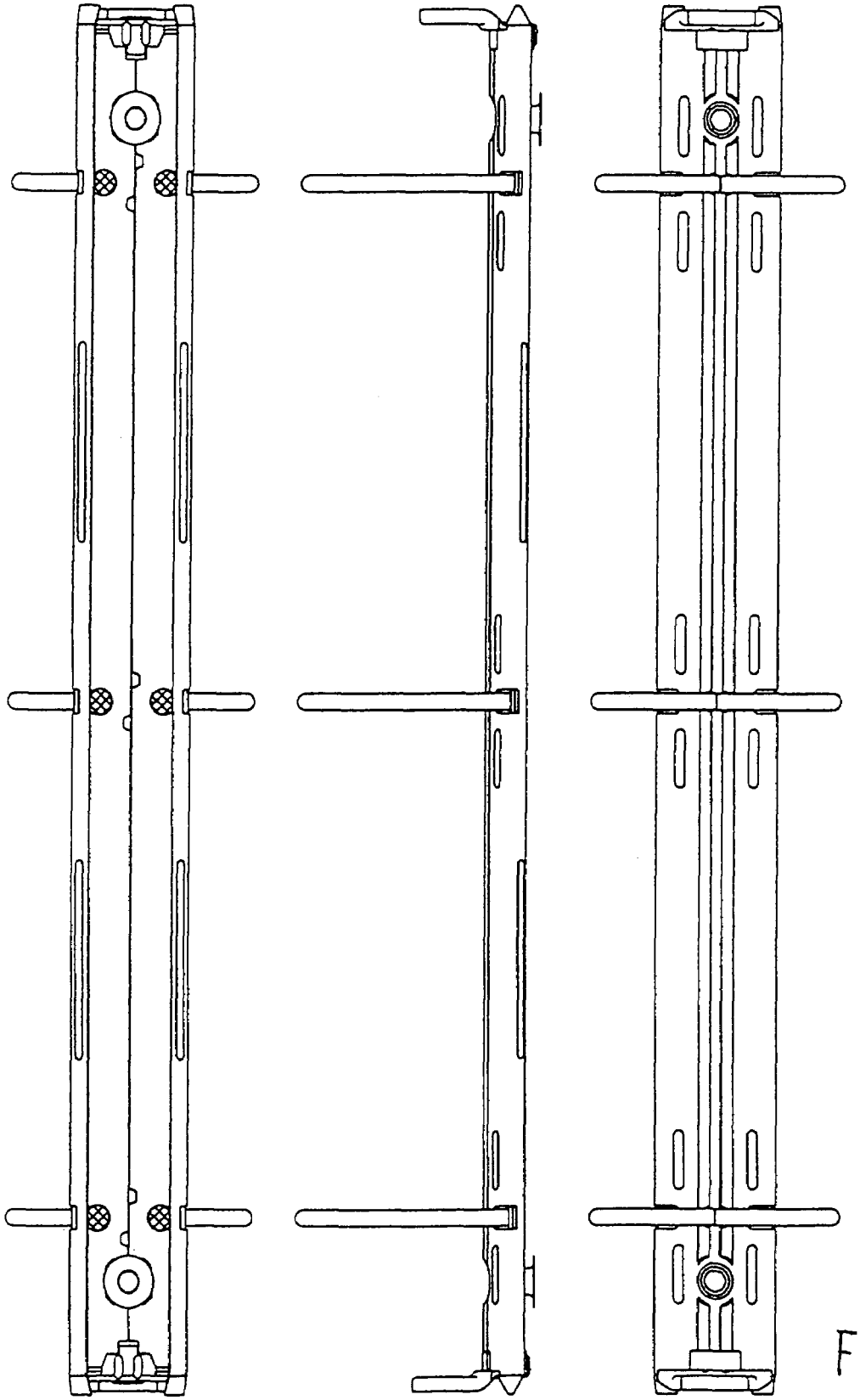
FIG. 6 are a front view, a side view and a back view showing the ring binder mechanism in FIG. 1.

The half ring elements 54 are provided on hinge plates 56 that are supported by the elongated plate 32 (FIGS. 2 and 4). The hinge plates 56 are provided for a pivotable movement, so as to move the ring elements between the closed position and the opened position. The hinge plates 56 are provided in parallel for attachment and connected in parallel to each other, so that they can pivotably rotate along the adjacent longitudinal edges. Slots 60 are provided in the hinge plates 56 for connecting to the ring elements. Each of the hinge plates 56 has an outer longitudinal edge 62 that is opposite to a fold line (FIG. 5). The longitudinal edges 62 are inserted into the corresponding bent bottom edges 44 of the elongated plate 32 respectively. The longitudinal edges 62 can move freely in the edges 44 respectively, so as to make the interconnected hinge plates 56 pivotably rotate. The elongated plate 32 provides a small elastic force to press the hinge plates 56 offset away from a common surface position (that is, to face towards the closed position or the opened position). A special control means that is generally indicated by 38 is provided for pivot rotating the hinge plates 56 in a controllable way, so as to move the ring elements between the closed position and the opened position. FIG. 6 shows the ring binder mechanism shown in FIG. 1 via a front view, a side view and a back view respectively.

Figure 7:
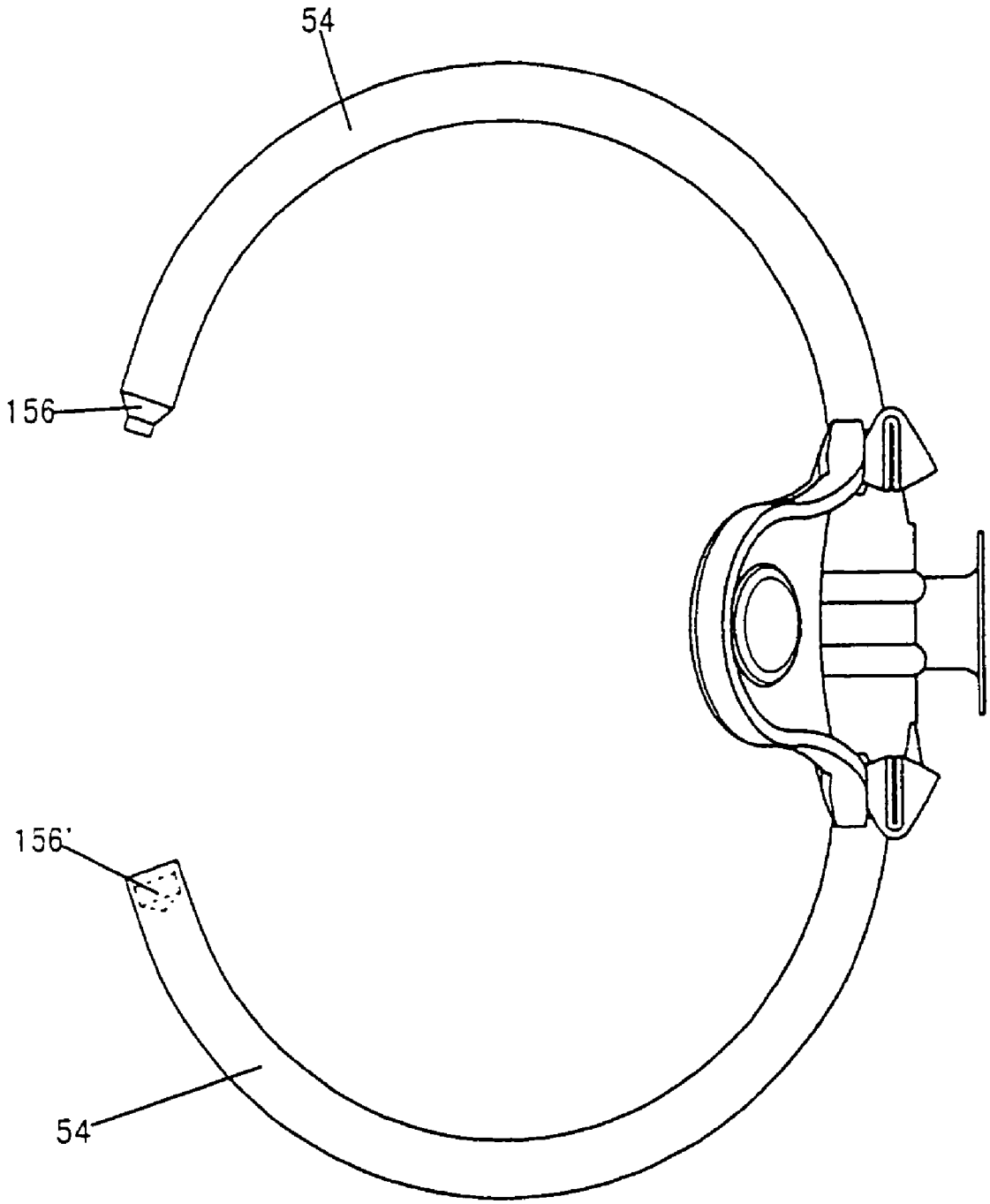
FIG. 7 is a partial front view of the ring binder mechanism in FIG. 1 in an opened and unclosed condition.
Figure 8:
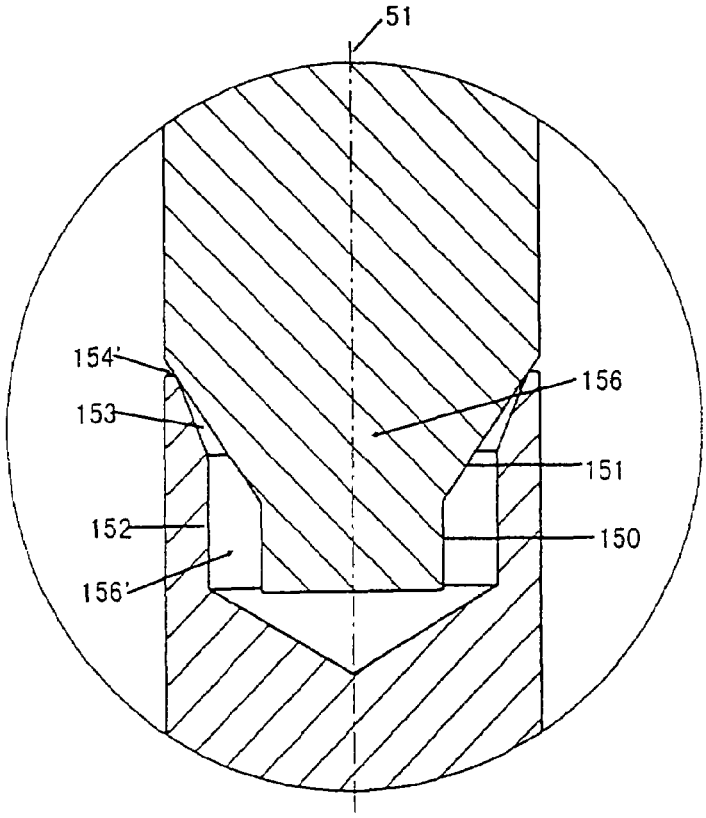
FIG. 8 is a partial front view showing a first embodiment of the ring elements of the ring binder mechanism in FIG. 1 which is in a closed condition, and a partial enlarged view showing the nesting configuration in a closed condition.
Figure 8:
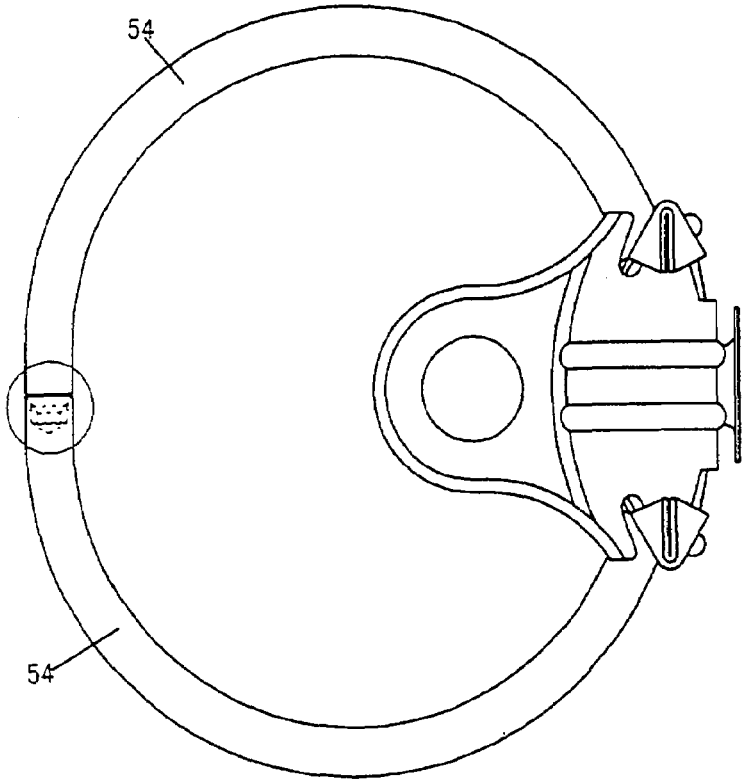

The ring elements of the ring binder mechanism according to the present invention will be further described as follows:

FIGS. 7 and 8 show a first embodiment of nesting portions 156, 156' of the ring element of the ring binder mechanism according to the present invention. As shown in the FIG. 8 that is a partial enlarged view, the nesting portions 156, 156' that are in the closed condition have a central axis line 51. The nesting portion 156 with a centrally convex portion along the axis line 51 is formed in a free end of one half ring element 54. A cylindrical tip 150 whose diameter is smaller than that of the cylindrical rod of the half ring element 54 is formed on the top portion of the nesting portion 156 around the axis line 51. The tip 150 is connected to a surface of the cylindrical rod of the half ring element 54 via an annulus conical surface 151. The nesting portion 156' with centrally concave portion along the axis line 51 is formed in a free end of the other engaging half ring element 54. The nesting portion 156' substantially forms a cylindrical hole 152 around the axis line 51. The cylindrical hole 152 has a conical portion in its bottom. The diameter of the cylindrical hole 152 is larger than that of the top cylinder portion of the nesting portion 156, but smaller than that of the cylindrical rod of the half ring element 54. By a conical hole 153 that tapers outwards, the cylindrical hole 152 is connected to an external end surface 154' of the nesting portion 156' at a position adjacent to an external surface of the cylindrical pole. A diameter of the conical hole 153 on the external end surface 154' is slightly smaller than that of the cylindrical rod of the half ring element 54. A cone angle of the conical hole of the centrally concave nesting portion 156' relative to the axis ling 51 is smaller than that of the annular conical surface of the centrally convex nesting portion 156. When the half ring elements 54 are in the closed condition, as shown in FIG. 8, the connecting portion between the external end surface 154' of the concave nesting portion 156' and the conical hole 153 engages with the annular conical surface 151 of the convex nesting portion 156, so that the centrally convex nesting portion 156 of the half ring elements 54 is nested in the centrally concave nesting portion 156' of the corresponding half ring elements 54. In this way, the engagement between the two nesting portions is tighter and the problem that the nesting portions are misaligned can be avoided.

Figure 9:
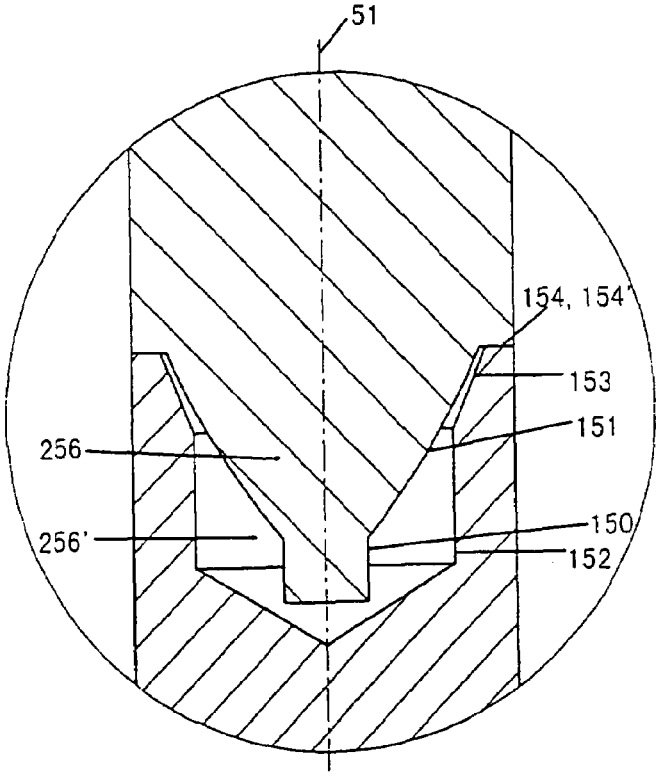
FIG. 9 is a partial front view showing a second embodiment of the ring elements of the ring binder mechanism in FIG. 1 that is in a closed condition, and a partial enlarged view showing the nesting configuration in a closed condition.
Figure 9:
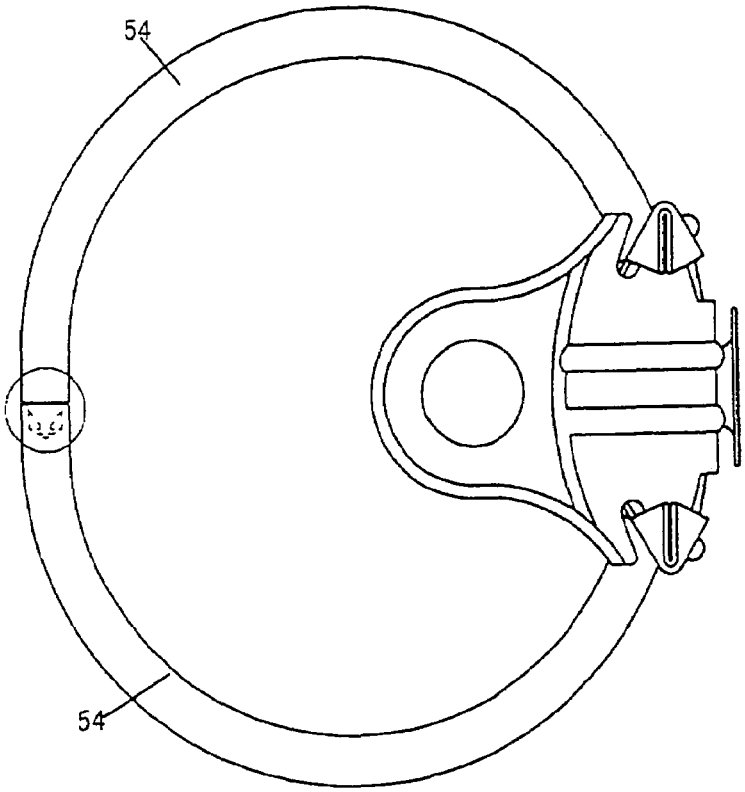

FIG. 9 shows a second embodiment of nesting portions 256, 256' of the ring element of the ring binder mechanism according to the present invention. As shown in the FIG. 9 that is a partial enlarged view, the nesting portions 256, 256' that are in the closed condition have a central axis line 51. The nesting portion 256 with centrally convex portion along the axis line 51 is formed in a free end of one half ring element 54. A cylindrical tip 150 whose diameter is smaller than that of the cylindrical rod of the half ring element 54 is formed on the top portion of the nesting portion 256 around the axis line 51. The tip 150 is connected to a position of an internal end surface 154 of the nesting portion 256 that is adjacent to an external surface of the cylindrical rod of the half ring element 54 via an arc-shaped annulus conical surface 151. The nesting portion 256' with a centrally concave portion along the axis line 51 is formed in a free end of the other engaging half ring element 54. The concave nesting portion 256' substantially forms a cylindrical hole 152 around the axis line 51. The cylindrical hole 152 has a conical portion in its bottom. The diameter of the cylindrical hole 152 is larger than that of the top cylinder portion of the convex nesting portion 256, but smaller than that of the cylindrical rod of the half ring element 54. By a conical hole 153 that tapers outwards, the cylindrical hole 152 is connected to the external end surface 154' of the nesting portion 256' at a position adjacent to an external surface of the cylindrical pole. A cone angle of the conical hole of the centrally concave nesting portion 256' relative to the axis ling 51 is smaller than that of the annular conical surface of the centrally convex nesting portion 256. A diameter of the conical hole 153 on the external end surface 154' is slightly larger than that of the annulus conical surface on the internal end surface 154. When the half ring elements 54 are in the closed condition, as shown in FIG. 9, the external end surface 154' of the concave nesting portion 256' and the internal end surface 154 of convex nesting portion 256 form a tight surface-engagement, so that the centrally convex nesting portion 256 of the half ring elements 54 is nested in the centrally concave nesting portion 256' of the corresponding half ring elements 54. In this way, the engagement between the two nesting portions is tighter and the problem that the nesting portions are misaligned can be avoided.

Figure 10:
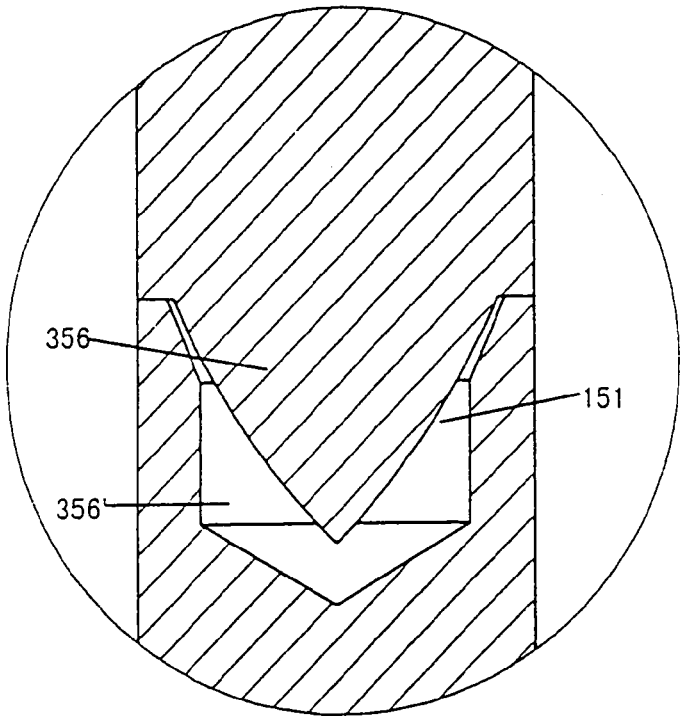
FIG. 10 is a partial front view showing a third embodiment of the ring elements of the ring binder mechanism in FIG. 1 that is in a closed condition, and a partial enlarged view showing the nesting configuration in a closed condition.
Figure 10:
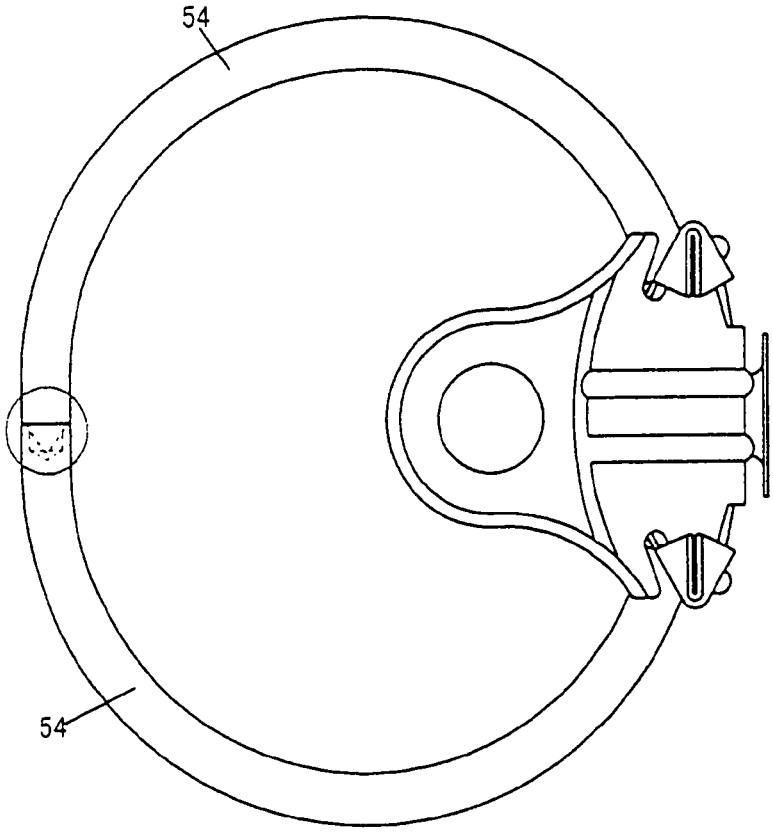

FIG. 10 shows a third embodiment of nesting portions 356, 356' of the ring element of the ring binder mechanism according to the present invention. The configuration of the third embodiment is substantially similar to that of the nesting portion shown in FIG. 9. The differences is in that: instead of the cylindrical tip and the an arc-shaped annulus conical surface shown in FIG. 9, an arc-shaped conical surface 151 is formed on the top portion of the convex nesting portion 356 around the axis line 51. In this way, the risk that paper is torn by the sharp edges of the nesting portions when the paper is added or removed can be eliminated.

Figure 11:
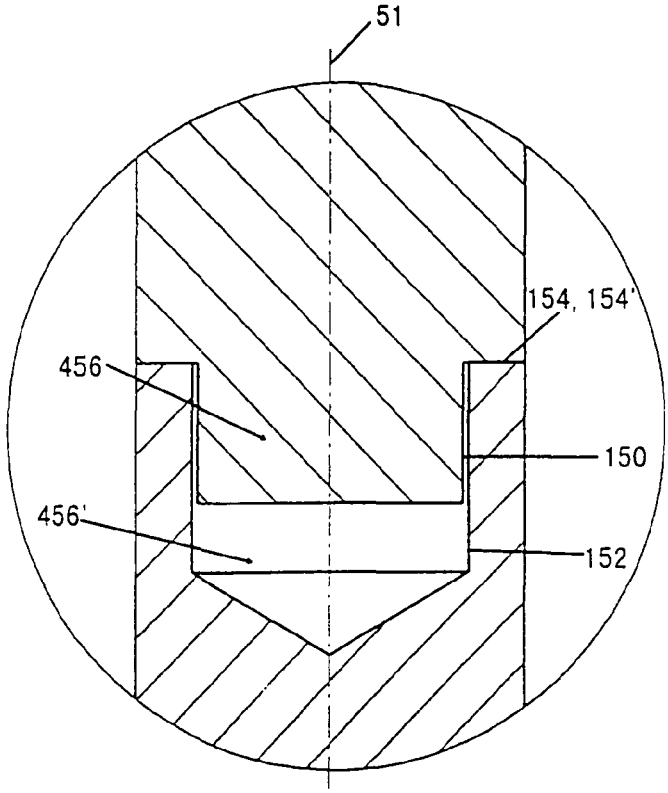
FIG. 11 is a partial front view showing a fourth embodiment of the ring elements of the ring binder mechanism in FIG. 1 that is in a closed condition, and a partial enlarged view showing the nesting configuration in a closed condition.
Figure 11:
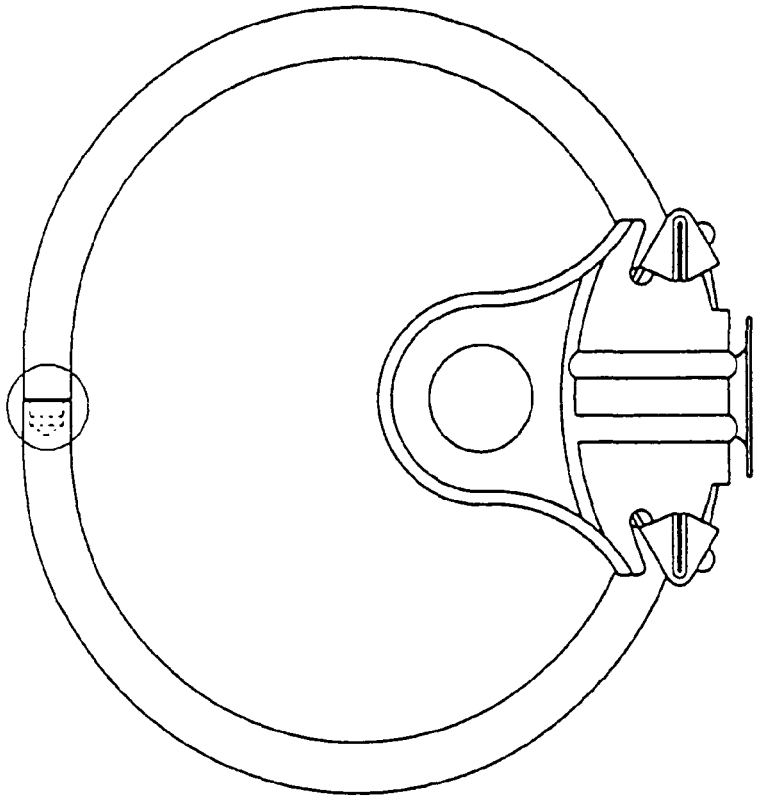

FIG. 11 shows a fourth embodiment of nesting portions 456, 456' of the ring element of the ring binder mechanism according to the present invention. As shown in the FIG. 11 that is a partial enlarged view, the nesting portions 456, 456' that are in the closed condition have a central axis line 51. The nesting portion 456 with centrally convex portion along the axis line 51 is formed in a free end of one half ring element 54. A cylindrical tip 150 whose diameter is smaller than that of the cylindrical rod of the half ring element 54 is formed on the top portion of the convex nesting portion 456 around the axis line 51. The tip 150 is connected to a surface of the cylindrical rod of the half ring element 54 via an internal end surface 154 of the convex nesting portion 456. The nesting portion 456' with centrally concave along the axis line 51 is formed in a free end of the other engaging half ring element 54. The concave nesting portion 456' substantially forms a cylindrical hole 152 around the axis line 51. The cylindrical hole 152 has a conical portion in its bottom. The diameter of the cylindrical hole 152 is larger than that of the tip 150 of the nesting portion 456, but smaller than that of the cylindrical rod of the half ring element 54. The cylindrical hole 152 is connected to an external surface of the cylindrical rod via an external end surface 154' of the concave nesting portion 456'. When the half ring elements 54 are in the closed condition, as shown in FIG. 11, the external end surface 154' of the concave nesting portion 456' and the internal end surface 154 of convex nesting portion 456 form a tight surface-engagement, so that the centrally convex nesting portion 456 of the half ring elements 54 is nested in the centrally concave nesting portion 456' of the corresponding half ring elements 54. In this way, the engagement between the two nesting portions is tighter and the problem that the nesting portions are misaligned can be avoided.

Figure 12:
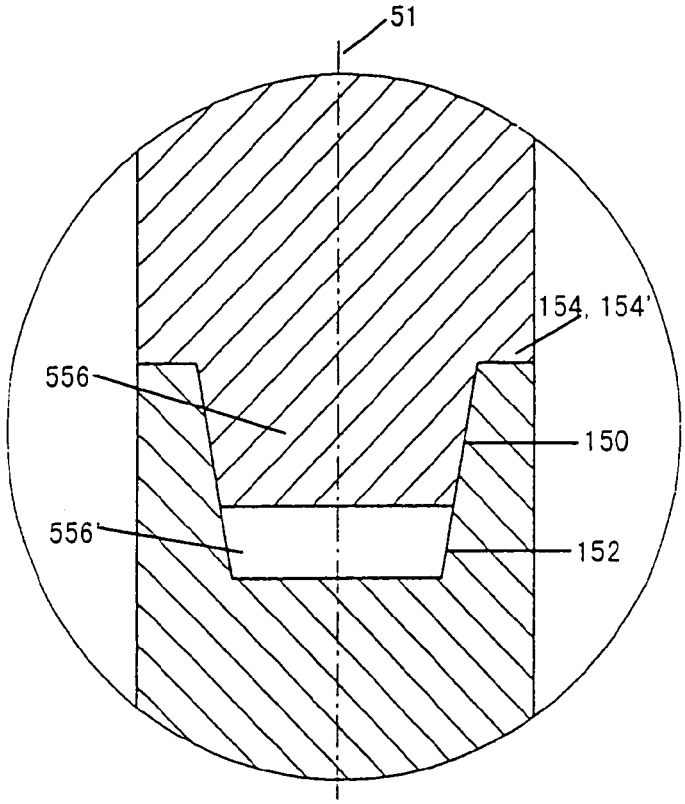
FIG. 12 is a partial front view showing a fifth embodiment of the ring elements of the ring binder mechanism in FIG. 1 that is in a closed condition, and a partial enlarged view showing the nesting configuration in a closed condition.
Figure 12:
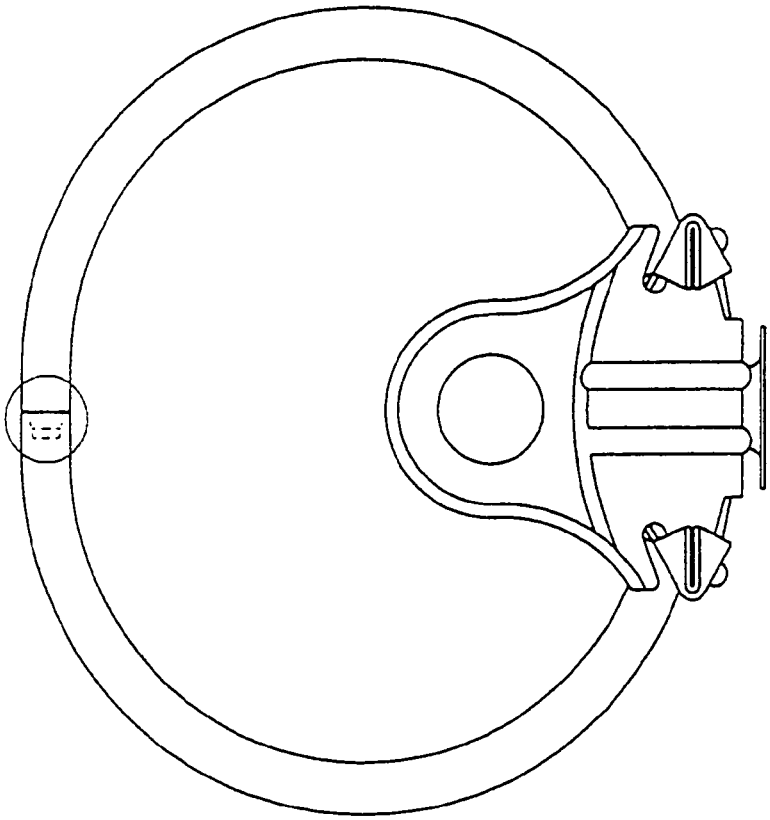

FIG. 12 shows a fifth embodiment of nesting portions 556, 556' of the ring element of the ring binder mechanism according to the present invention. As shown in the FIG. 12 that is a partial enlarged view, the nesting portions 556, 556' that are in the closed condition have a central axis line 51. The nesting portion 556 with centrally convex portion along the axis line 51 is formed in a free end of one half ring element 54. A flat top frusto-conical portion 150 is formed on the top portion of the convex nesting portion 556 around the axis line 51. The flat top frusto-conical portion 150 is connected to a surface of the cylindrical rod of the half ring element 54 via an internal end surface 154 of the convex nesting portion 556. The nesting portion 556' with centrally concave portion along the axis line 51 is formed in a free end of the other engaging half ring element 54. The concave nesting portion 556' substantially forms a flat bottom frusto-conical hole 152 around the axis line 51. The frusto-conical hole 152 is connected to an external surface of the cylindrical rod via an external end surface 154' of the concave nesting portion 556'. A cone angle of the frusto-conical hole of the centrally concave nesting portion 556' relative to the axis ling 51 is substantially equal to that of the flat top frusto-conical portion 150 of the centrally convex nesting portion 556, and a diameter of the flat bottom frusto-conical hole 152 on the external end surface 154' is slightly equal to that of the flat top frusto-conical portion 150 on the internal end surface 154. When the half ring elements 54 are in the closed condition, as shown in FIG. 12, the external end surface 154' of the concave nesting portion 556' and the internal end surface 154 of convex nesting portion 556 form a tight surface-engagement, so that the centrally convex nesting portion 556 of the half ring elements 54 is nested in the centrally concave nesting portion 556' of the corresponding half ring elements 54. In this way, the engagement between the two nesting portions is tighter and the problem that the nesting portions are misaligned can be avoided.

Figure 13:
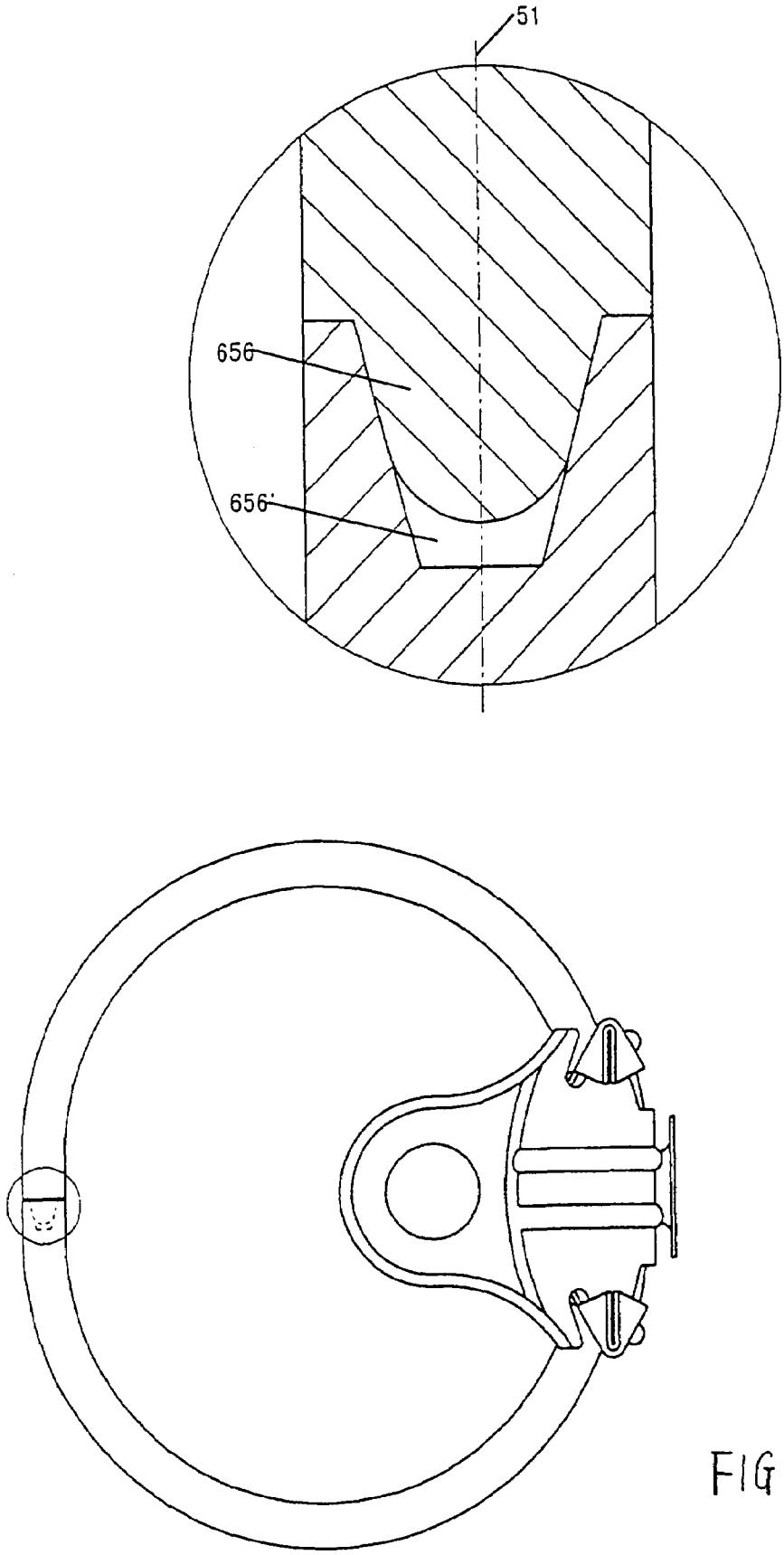
FIG. 13 is a partial front view showing a sixth embodiment of the ring elements of the ring binder mechanism shown in FIG. 1 that is in a closed condition, and a partial enlarged view showing the nesting configuration in a closed condition.

FIG. 13 shows a sixth embodiment of nesting portions 656, 656' of the ring element of the ring binder mechanism according to the present invention. The configuration of the sixth embodiment is substantially similar to that of the nesting portion shown in FIG. 12. The difference is in that: the flat top frusto-conical portion of the nesting portion 556 shown in FIG. 11 is replaced with an arc-shaped top frusto-conical portion shown in FIG. 13. In this way, the risk that paper is torn by the sharp edges of the nesting portions when the paper is added or removed can be eliminated.

Figure 14:
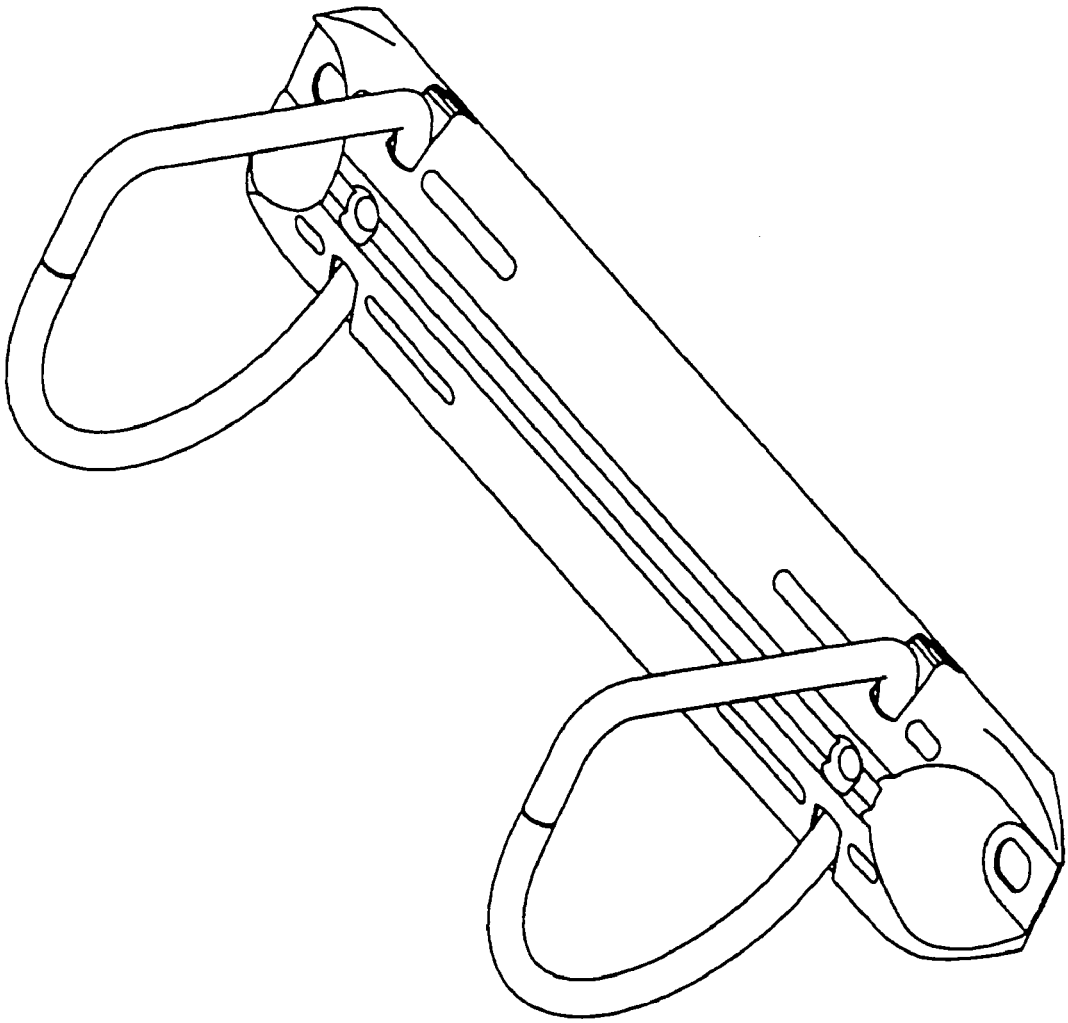
FIG. 14 is a top perspective view showing another ring binder mechanism in a closed condition according to the present invention, and a partial front view showing the ring element of the ring binder that is in a closed condition.
Figure 14:
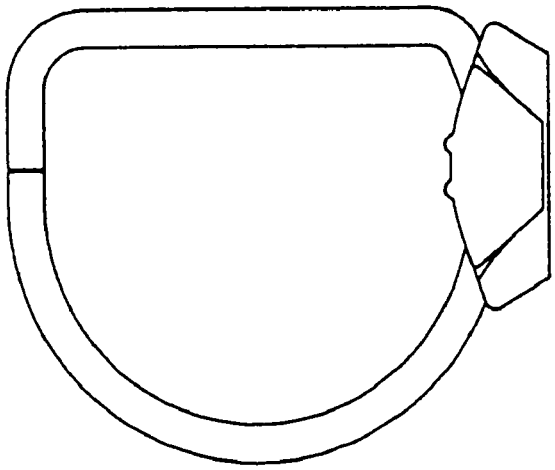
Figure 15:
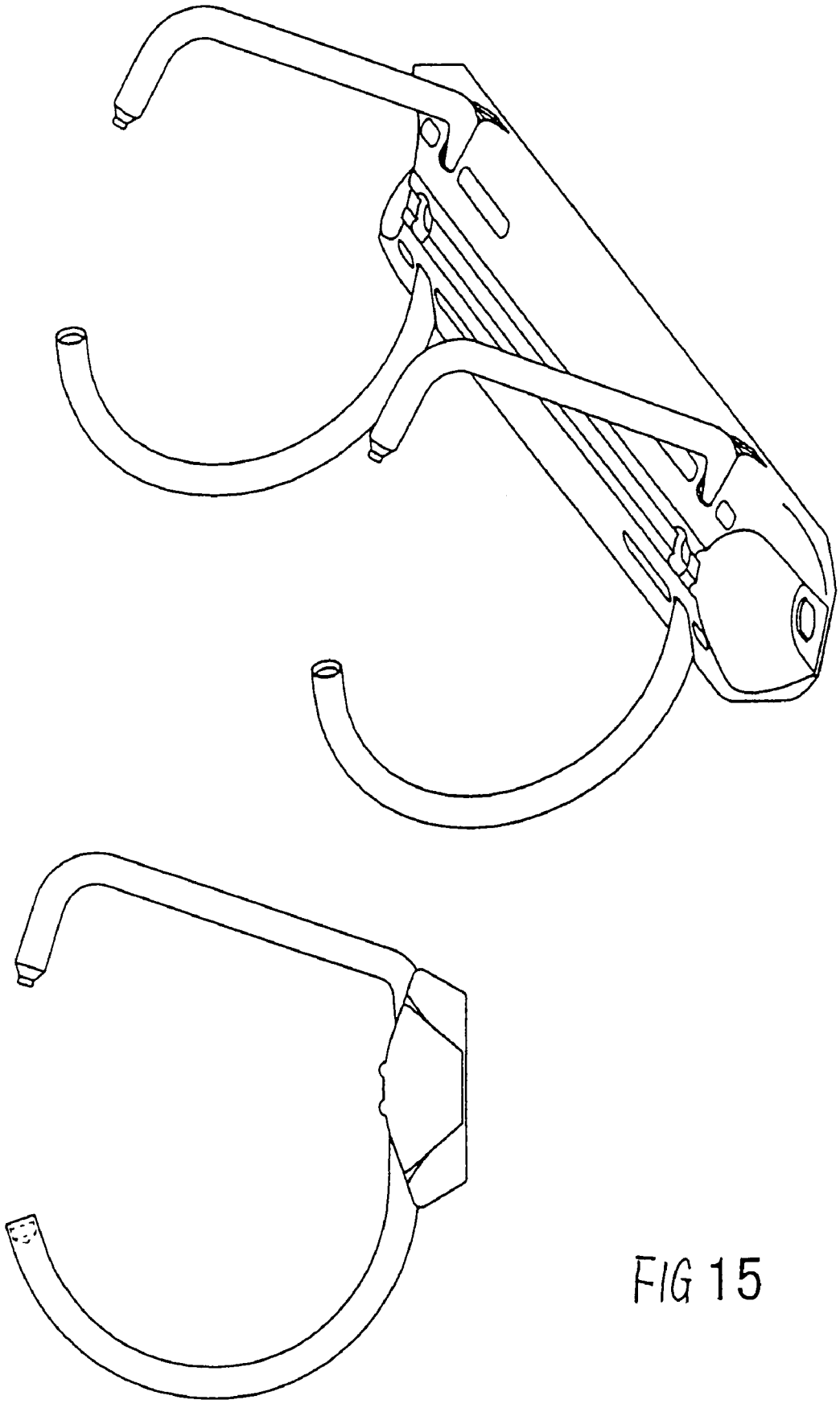
FIG. 15 is a top perspective view showing the ring binder mechanism in FIG. 14 in an opened condition, and a partial front view showing this ring element of the ring binder that is in an opened condition.

FIGS. 14 and 15 show another ring binder mechanism according to the present invention that is in a closed condition. The mechanism comprises two rings. One of the half ring elements of each of said rings has a straight side. The nesting portions of the ring elements of the ring binder mechanism also can have the configuration of the above mentioned first to sixth embodiments shown in FIGS. 7 to 13.

Figure 16:
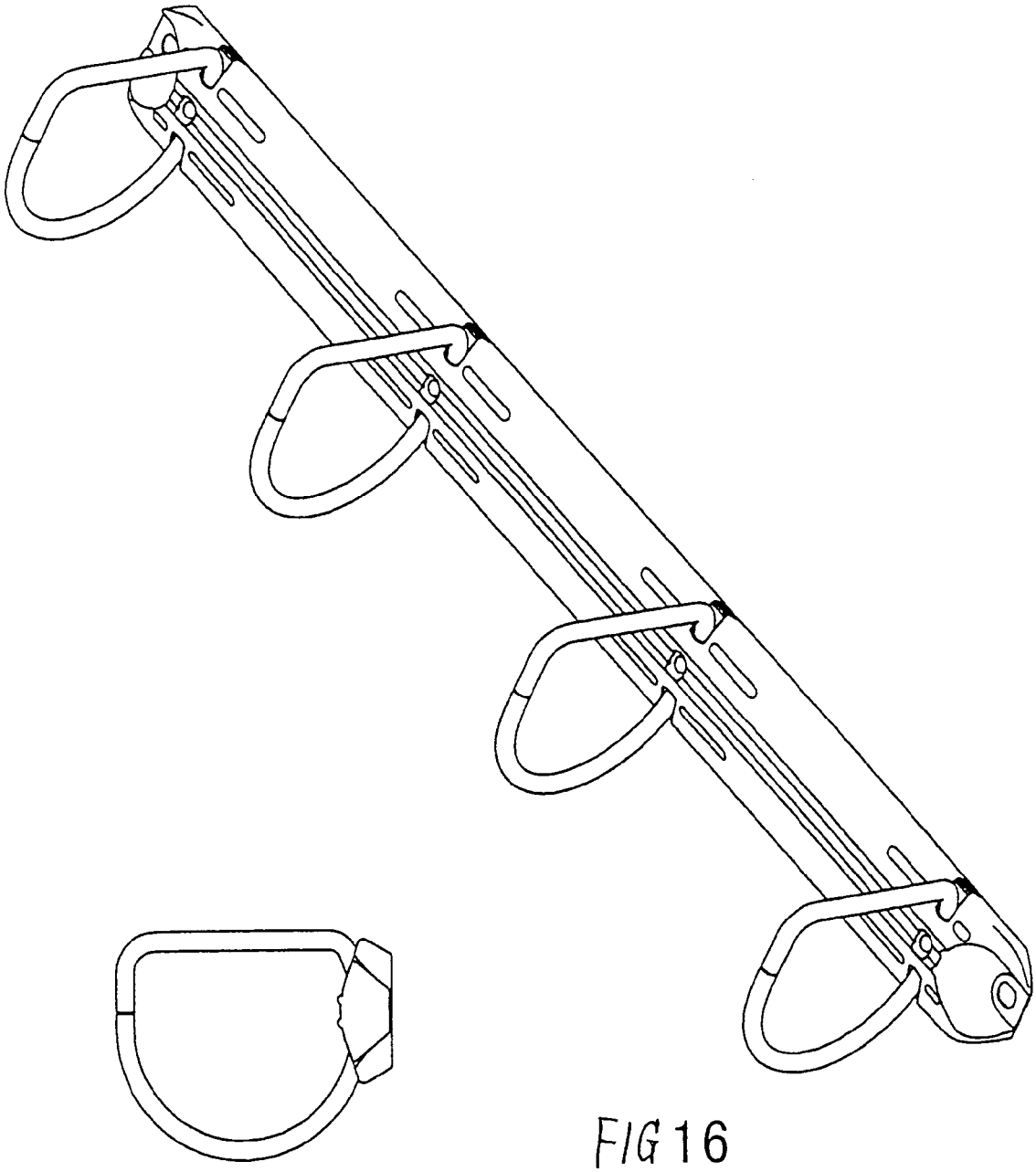
FIG. 16 is a top perspective view showing still another ring binder mechanism in a closed condition according to the present invention, and a partial front view showing the ring element of this ring binder that is in a closed condition.
Figure 17:
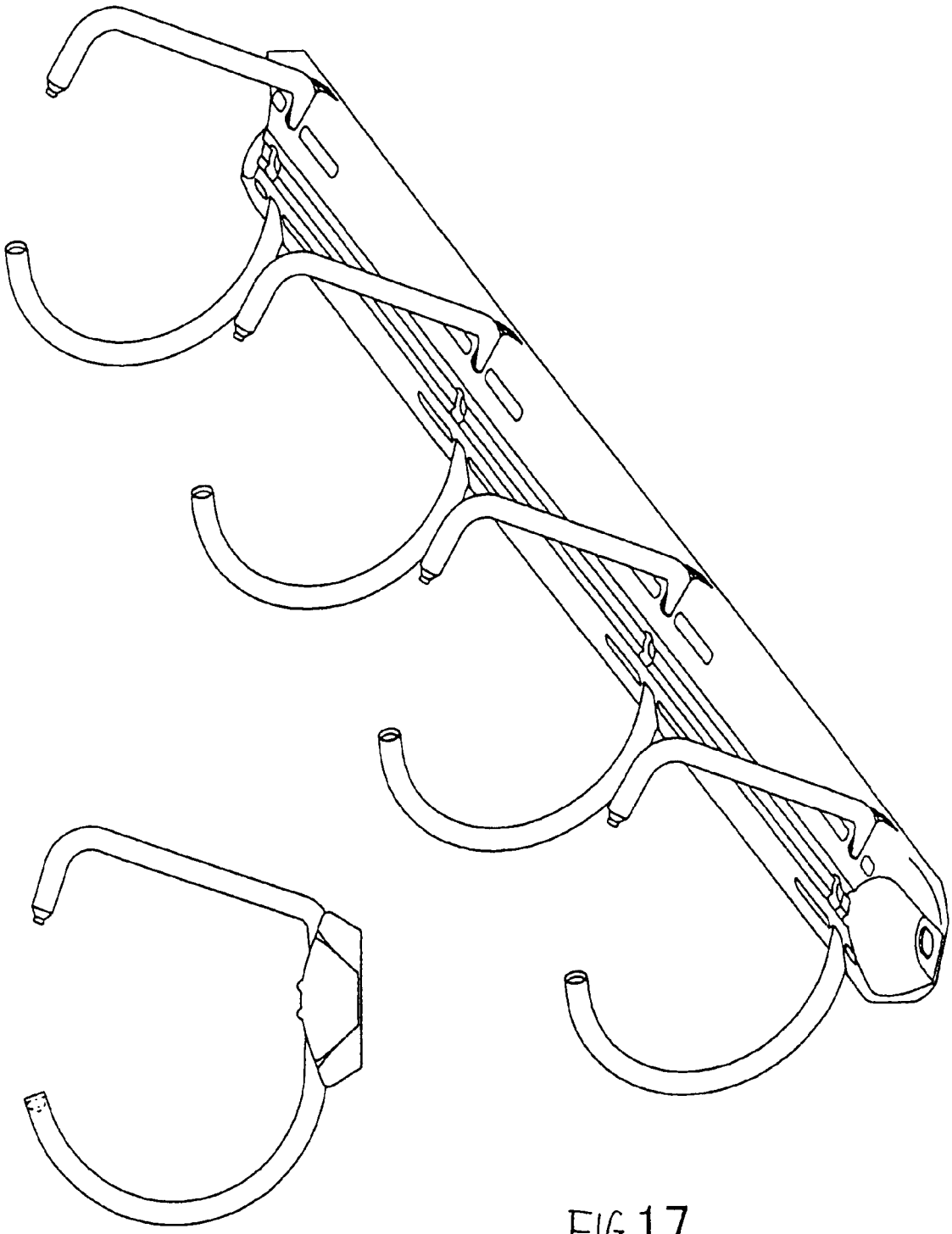
FIG. 17 is a top perspective view showing the ring binder mechanism in FIG. 16 in an opened condition, and a partial front view showing the ring element of this ring binder that is in an opened condition.

FIGS. 16 and 17 show another ring binder mechanism according to the present invention that is in a closed condition and an opened condition, respectively. The mechanism comprises four rings. One of the half ring elements of each of said rings has a straight side, similar to FIGS. 14 and 15. The nesting portions of the ring elements of the ring binder mechanism also can have the configuration of the above mentioned first to sixth embodiments shown in FIGS. 7 to 13. In addition, those kinds of mechanism which have various numbers, such as more than or less than four rings are all fell into the scope of the present invention.

Figure 18:
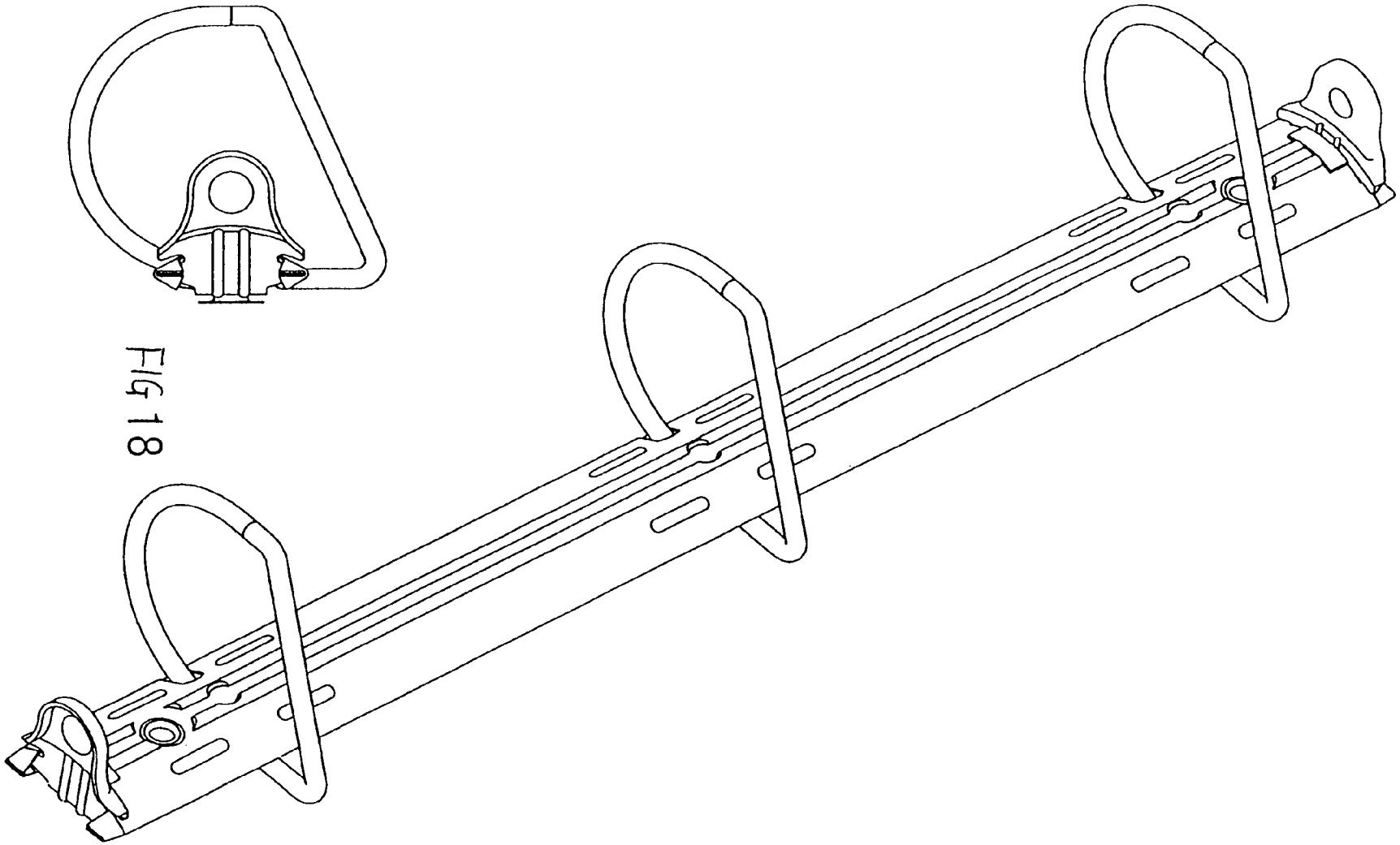
FIG. 18 is a top perspective view showing still another ring binder mechanism in a closed condition according to the present invention, and a partial front view showing this ring element of this ring binder that is in a closed condition.
Figure 19:
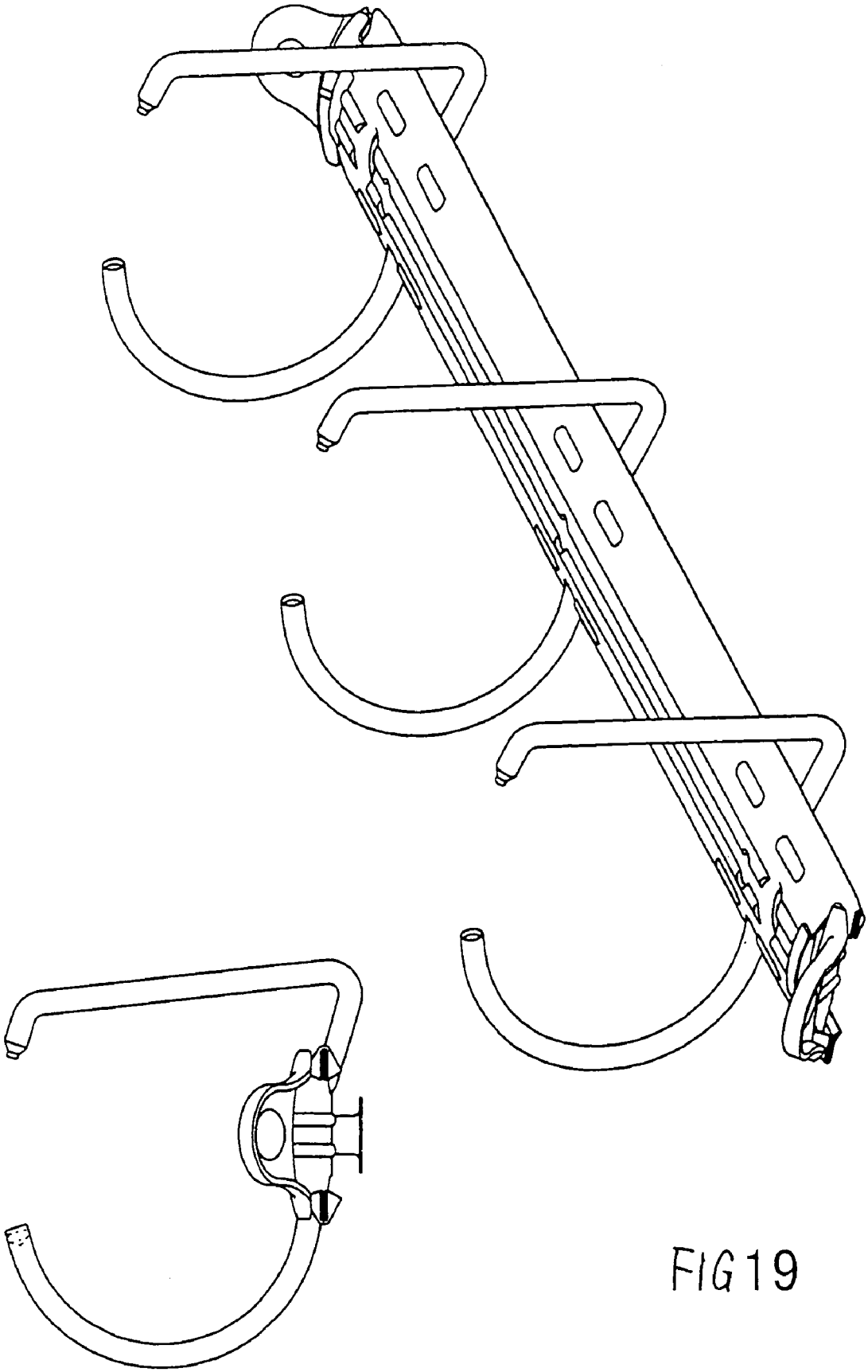
FIG. 19 is a top perspective view showing the ring binder mechanism in FIG. 18 in an opened condition, and a partial front view showing the ring element of this ring binder that is in an opened condition.
Figure 20:
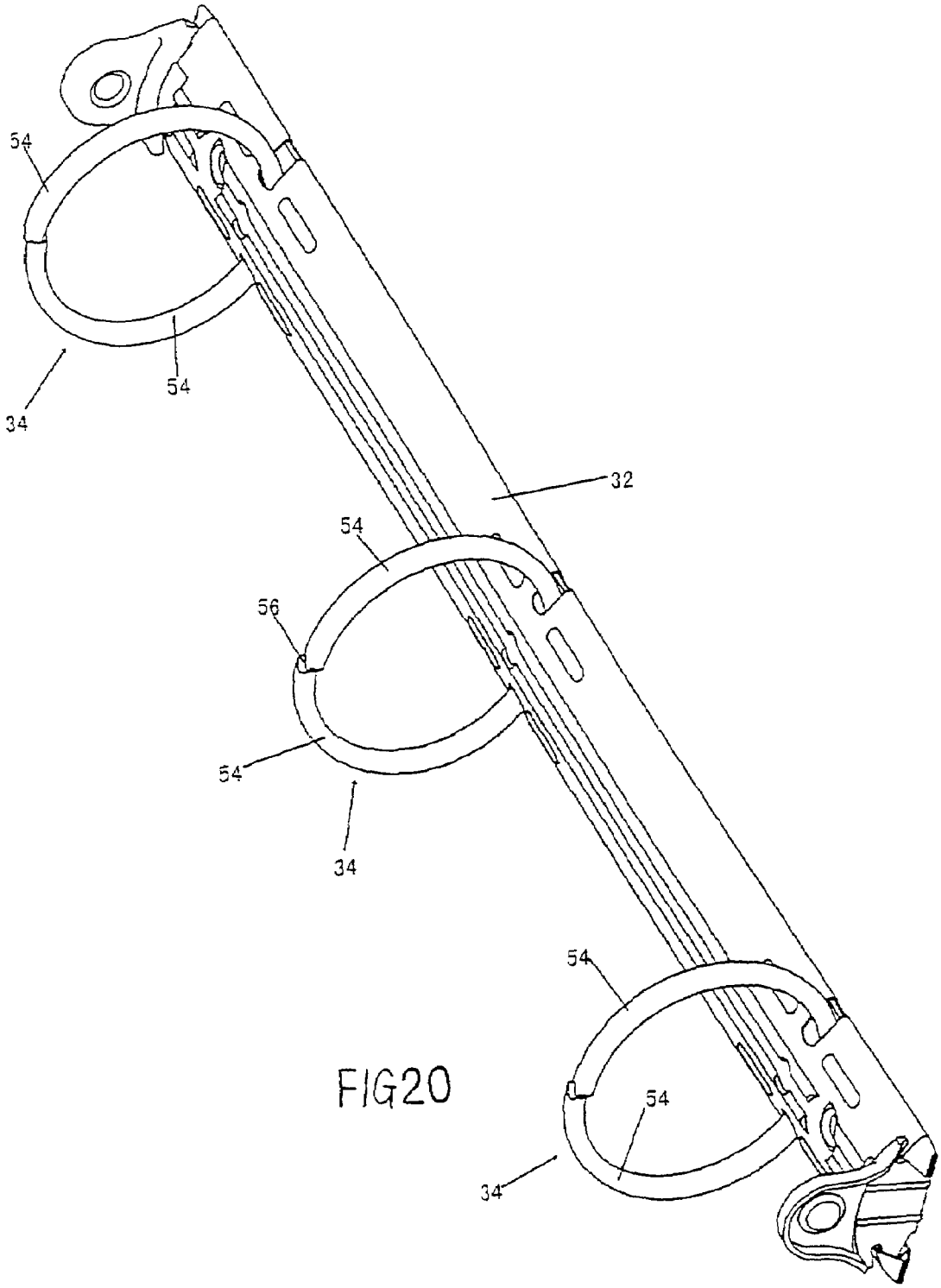
FIG20 Prior Art
FIGS. 20 and 21 are a perspective view and a partial enlarged perspective view, respectively, showing a ring binder of the prior art.
Figure 21:
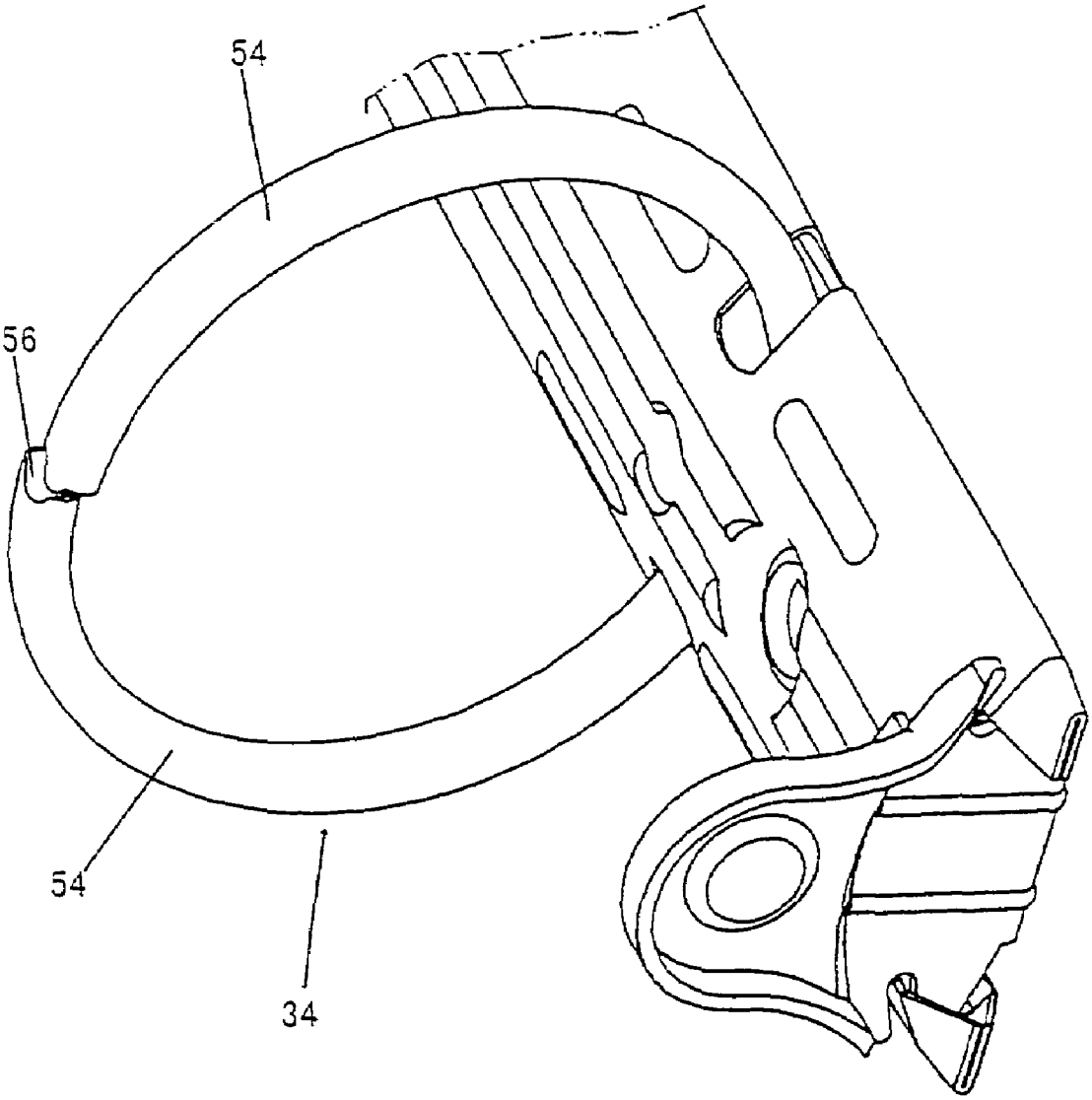
Prior Art FIG 21

FIGS. 18 and 19 show another ring binder mechanism according to the present invention that is in a closed condition and an opened condition, respectively. The mechanism comprises three rings. One of the half ring elements of each of said rings has an inclined straight side. The nesting portions of the ring elements of the ring binder mechanism also can have the configuration of the above mentioned first to sixth embodiments shown in FIGS. 7 to 13. In addition, those kinds of mechanism which have various numbers, such as more than or less than three rings, all fall into the scope of the present invention.

Because various modifications can be done without departing from the scope of the present invention, it should be understood that all the content that is included in the above description and are shown in the figures is only instructive, while not limiting the scope of the invention.

The invention claimed is:

1. A ring binder mechanism for binding the sheets of loose leaves, the mechanism comprising:

an elongated spring plate that extends longitudinally and, in profile, has a shallow U-shaped configuration and opposite edges which extend substantially toward each other, said spring plate having at least one hole with a bushing therein for attachment of the ring binder mechanism to a file folder;

two parallel elongate hinge plates supported by said spring plate for pivotal toggle motion relative to the spring plate about a central hinge line, the hinge plates being mounted in parallel and retained by the opposite edges of the spring plate;

a plurality of rings for clasping said sheets of loose leaves, each of the rings comprising a pair of half ring elements mounted on said hinge plates, with one half ring element of each pair being attached to one of the hinge plates and the other half ring element of the pair attached to the other hinge plate, with the two half ring elements of each pair in substantial alignment, the pairs of half ring elements being movable with said hinge plates to toggle between an open position and a closed position and forming a substantially annular shape when in the closed position; and wherein free ends of the half ring of each pair elements form a nesting configuration when in the closed position, the free end of one half ring element of each pair having a centrally concave nesting portion and the free end of the other half ring element of the pair having a centrally convex nesting portion, said concave portion and said convex portion being symmetrical about an axis line of the respective ring elements of the pair, so that when the pair of half ring elements are in the closed condition, the free ends of the half ring elements are aligned to each other and form a single line contact-engagement so that the convex nesting portion and the concave nesting portion are nested together tightly;

wherein said centrally convex portion of one half ring element of each pair has an annular external conical surface which extends directly from a first cylindrical outer surface of a cylindrical rod forming the respective one half ring element to a second cylindrical outer surface of a cylindrical end portion thereof:

wherein said centrally concave portion has a centrally cylindrical hole that is formed in the end of the other half ring element of each pair and an internal conical surface extending between a third cylindrical inner surface of said cylindrical hole toward a fourth cylindrical outer surface of a cylindrical rod forming the respective other half ring element; and wherein a maximum diameter of the internal conical hole surface is smaller than that of said cylindrical rod forming the respective other half ring element, a cone angle of said internal conical surface is smaller than that of the annular external conical surface of the centrally protruding outwards nesting portion, such that when the half ring elements are in the closed condition, a connecting portion between the fourth cylindrical outer surface of the concave nesting portion and the internal conical surface thereof engages with the external conical surface of the convex nesting portion in a single line contact such that the end portion of the convex nesting portion extending past the line contact does not engage with the concave nesting portion and thereby causes the convex nesting portion to nest centrally in the concave nesting portion.

2. A ring binder mechanism according to claim 1, wherein two, three, four or more rings are provided in said ring binder mechanism.

3. A ring binder mechanism according to claim 1, wherein said rings are made of metal material.

4. A ring binder mechanism according to claim 1, wherein said rings are made of plastic material.

5. A ring binder mechanism according to claim 1, wherein said rings are formed integrally with said hinge plates.

6. A ring binder mechanism according to claim 1, wherein the pair of half ring elements of said ring binder mechanism form a circular ring.

7. A ring binder mechanism according to claim 1, wherein one half ring element of said pair of half ring elements of said ring binder mechanism has a straight side.

* * * * *